US010344563B2

(12) United States Patent
Esslemont et al.

(10) Patent No.: US 10,344,563 B2
(45) Date of Patent: Jul. 9, 2019

(54) MULTI-BAR SCRAPER FOR CLEANING MARINE RISERS AND WELLBORES

(71) Applicant: Abrado, Inc., Houston, TX (US)

(72) Inventors: Alexander Esslemont, Houston, TX (US); Benny Silguero, Houston, TX (US); John Wolf, Houston, TX (US)

(73) Assignee: Abrado, Inc., Houston, TX (US)

( * ) Notice: Subject to any disclaimer, the term of this patent is extended or adjusted under 35 U.S.C. 154(b) by 0 days.

(21) Appl. No.: 15/535,200

(22) PCT Filed: Dec. 16, 2015

(86) PCT No.: PCT/US2015/066143

§ 371 (c)(1),
(2) Date: Jun. 12, 2017

(87) PCT Pub. No.: WO2016/100540

PCT Pub. Date: Jun. 23, 2016

(65) Prior Publication Data

US 2017/0362917 A1 Dec. 21, 2017

Related U.S. Application Data

(60) Provisional application No. 62/094,507, filed on Dec. 19, 2014.

(51) Int. Cl.

| | |
|---|---|
| ***E21B 37/02*** | (2006.01) |
| ***B08B 9/027*** | (2006.01) |
| ***B08B 9/045*** | (2006.01) |
| ***B24B 5/40*** | (2006.01) |
| ***B08B 9/38*** | (2006.01) |
| ***B08B 9/043*** | (2006.01) |

(52) U.S. Cl.
CPC ..... *E21B 37/02* (2013.01); *B08B 9/027* (2013.01); *B08B 9/045* (2013.01); *B08B 9/0436* (2013.01); *B08B 9/38* (2013.01); *B24B 5/40* (2013.01)

(58) Field of Classification Search
CPC ..... E21B 37/02; B08B 9/0436
USPC ..... 166/173
See application file for complete search history.

(56) References Cited

U.S. PATENT DOCUMENTS

| | | | |
|---|---|---|---|
| 4,798,246 | A | 1/1989 | Best |
| 6,209,647 | B1 | 4/2001 | Brown |
| 7,311,141 | B2 | 12/2007 | Tulloch |

(Continued)

OTHER PUBLICATIONS

PCT International Search Report and Written Opinion dated Feb. 26, 2016 (copy attached).

*Primary Examiner* — Taras P Bemko
(74) *Attorney, Agent, or Firm* — Ted M. Anthony

(57) ABSTRACT

An instrument for the mechanical removal of corrosive buildup, deposits or scale from within a wellbore. A tubing-conveyed scraping blade and/or other abrading devices (50) has a collapsible maximum outer diameter by using a multi-bar mechanism (53, 54) to ensure physical contact with corrosive buildup, deposits or scale on surfaces of a surrounding wellbore, oil and gas tubular, or drilling/production marine riser (and, in particular, inner surfaces thereof). The multi-bar mechanism allows for a wide range of motion irrespective of the direction of loading and variable maximum outer diameter to clean corrosive buildup, deposits or scale from tubular goods with unknown configurations and/or dimensions.

6 Claims, 5 Drawing Sheets

(56) References Cited

U.S. PATENT DOCUMENTS

| | | | | |
|---|---|---|---|---|
| 8,511,375 | B2 | 8/2013 | Hern | |
| 2005/0205252 | A1 * | 9/2005 | Tulloch | E21B 37/02 166/173 |
| 2009/0272524 | A1 | 11/2009 | Voth | |

* cited by examiner

MULTI-BAR SCRAPER FOR CLEANING MARINE RISERS AND WELLBORES

BACKGROUND OF THE INVENTION

1. Field of the Invention

The present invention pertains to a method and apparatus for cleaning or removal of gelled drilling mud, well cuttings, scale and/or other debris from the internal surfaces of wellbore tubular goods and/or equipment used during the drilling of such wellbores (including, but not limited to, wellbore casing strings, subsea wellheads and drilling risers).

2. Brief Description of the Prior Art

During well drilling operations, wells are typically filled with a fluid known as drilling mud, which is also sometimes referred to as drilling fluid. Drilling mud is typically a combination of water or liquid petroleum product(s) mixed with clays and other chemicals to create a homogeneous blend. Other chemicals are frequently added to such drilling mud in order to achieve various desired characteristics including, without limitation, viscosity control, shale stability, enhanced drilling performance, bit cooling and equipment lubrication.

In many cases, such drilling mud is pumped down the longitudinally extending bore of drill pipe or other tubular string, and then circulated up the annular space formed between the external surface of said drill pipe and the internal surface of the surrounding casing or open hole wellbore. The drilling mud typically serves a variety of functions including, without limitation, to cool and lubricate drill bits and other downhole equipment; to transport pieces of drilled-up rock and other debris from the bottom of a well to the surface; to provide hydrostatic pressure to control encountered subsurface pressures; and to seal porous rock formations with a substantially impermeable filter cake.

In addition to drilling mud, a wellbore environment can also include drilled rock cuttings, milled metallic solids, cement pieces, scale and/or other debris generated during the drilling process. Unfortunately, such materials can negatively impact efficiency of drilling or other down hole operations and prevent down hole tools from operating properly. Further, if allowed to remain within a wellbore, such materials can also negatively impact productivity of subterranean formations encountered by said wellbore.

After a well has been drilled to a desired depth and casing has been installed, such drilling mud (together with any associated drill cuttings, cement pieces and/or other debris) is typically removed from a well and replaced with substantially clear completion fluid, which is frequently a weighted brine or other similar liquid. A "clean" wellbore generally promotes a successful completion process and enhanced production/injection performance by minimizing or eliminating fine solids commonly found in drilling mud that can be damaging to hydrocarbon producing reservoirs. Further, a "clean" wellbore also minimizes down hole mechanical failures (such as, for example, leaking packers, packed-off screens and stuck valves) caused by such solid materials.

Thus, cleaning of wellbores, tubulars, and marine risers is a necessary prior step in ensuring a successful and efficient completion of an oil and gas well. Most wells typically require a comprehensive wellbore cleanout service to ensure that all drilling mud, cement and/or other debris are fully removed from a well prior to installing expensive and complex completion equipment; debris left in a completed well can cause problems setting and retrieving downhole tools, wellbore formation damage, loss of production, and a shortened lifespan of a producing or injecting well. Conventional wellbore cleanout operations typically involve a combination of abrasive brushes, scrapers, magnets or other mechanical tools, together with specially formulated displacement chemicals.

When conducting mechanical operations to clean debris, corrosive buildup, deposits or scale from wellbores, oil and gas tubular goods, or drilling/production marine risers, it is essential to know wellbore geometries, wellbore conditions, and physical constraints prior to commencing such operations. Such information can help prevent mechanical abrasive or scraping tools—which are designed to contact the inner surface of wellbore equipment and tubular goods—from becoming stuck within a wellbore. Such information can also help avoid expensive delay, production impairment, damage to wellbore components, and/or ineffective cleaning operations.

In the case of marine drilling risers with many internal profiles, upsets, different wall thicknesses and scale/corrosion build ups, some of which are either unknown, or unverifiable, prior to deploying scraping/abrading tools in a wellbore and commencing such mechanical operations, this lack of specific advance information can create an unacceptable degree of risk regarding possible sticking of such mechanical tools and/or damaging of downhole equipment or tubular goods.

In the case of marine drilling risers with many internal profiles, upsets and different wall thicknesses, where all dimensions are known, prior to deploying scraping/abrading tools in a wellbore and commencing such mechanical operations, the scraper must be able to collapse and extend reactively to conform to any longitudinal or lateral loading exerted by such internal profiles, upsets and different wall thicknesses. Failure to collapse and extend reactively can create an unacceptable degree of risk regarding possible sticking of such mechanical tools and/or damaging of downhole equipment or tubular goods.

Thus, there is a need for a mechanical wellbore cleanout scraper assembly that automatically compensates for a wide range of downhole marine riser internal configurations and dimensions irrespective of the loading direction.

SUMMARY OF THE INVENTION

Briefly and in general terms, the present invention provides an improved method and apparatus for the removal of corrosive buildup, deposits or scale buildup from within a wellbore, oil and gas tubular, or drilling/production marine riser.

The adjustable scraper assembly of the present invention can be conveyed into a wellbore or drilling/production marine riser from surface, and manipulated within said wellbore, via a tubular workstring (such as drill pipe, for example). Said scraper assembly can be included within a tool string assembly (that is, as part of a combination of tools for wellbore cleanout and validation) or, alternatively, as a standalone tool. Fluid can be circulated via said workstring to circulate solids and debris from out of the wellbore, oil and gas tubular goods, drilling/production marine riser, or other annuli.

The scraper assembly of the present invention comprises a multi-bar mechanism. Said multi-bar mechanism provides an adjustable, wide range of outer diameter coverage in a 360-degree pattern around said scraper assembly, while also applying significant constant force in an outward radial direction. Such force is generally applied in a direction that is substantially perpendicular to the longitudinal axis of said scraper assembly for effective abrasion of corrosive buildup, deposits and/or scale on surrounding surfaces.

In a preferred embodiment, a scraper is affixed to the coupler linkage of a multi-bar linkage mechanism. Both an input link and a follower link are fixed bases with the follower link (positioned on the down hole end of the scraper assembly) being longer than the input link (positioned at the up hole facing end of the scraper assembly). Such a configuration ensures that the linkage system depresses first from the down hole end of the coupler linkage when obstructions are encountered.

In a preferred embodiment, both said input and follower links are essentially "triangular"-shaped with apexes facing opposite and connected to one another with a spring or other biasing device. Said spring or biasing device acts to continuously force a coupler link (and the affixed scraper) in a radially outward direction. In instances when a scraper is affixed to said coupler linkage, the aforementioned motion provides the necessary force for scraping and abrasion of corrosive buildup, deposits or scale.

To achieve 360-degree abrasive coverage of a wellbore, oil and gas tubular, or drilling/production marine riser annulus, multiple independent multi-bar linkage systems can be housed within an outer body member comprising multiple slot housings. Each slot housing is positioned in phased relationship in order to overlap or ensure complete circumferential coverage when all scraper coupler linkages are engaged. Moreover, multiple "stacked" scraper assemblies can be run in order to further ensure 360-degree abrasive coverage of surrounding wellbore surfaces.

A multi-bar linkage system is disposed within each slot housing. Each multi-bar linkage system comprises an input, coupler link, and follower link. A scraper or other abrading devices is affixed to the coupler link; said scraper or other abrading device can be beneficially curved with a radius of curvature optimized to contact the maximum surface area of the surrounding inner surface of wellbore, oil and gas tubular good, or drilling/production marine riser intended to be cleaned.

The aforementioned slotted sleeve housing containing a plurality of multi-bar linkage systems is affixed to a two-part mandrel and held in place by a top and bottom 'sub'. When the mandrel is assembled together, the upper and lower edge of the slotted sleeve housing is located within grooves in the top and bottom sub. The slotted sleeve housing, top and bottom sub are free to rotate around the inner mandrel.

BRIEF DESCRIPTION OF THE DRAWINGS

The foregoing summary, as well as any detailed description of the preferred embodiments, is better understood when read in conjunction with the drawings and figures contained herein. For the purpose of illustrating the invention, the drawings and figures show certain preferred embodiments. It is understood, however, that the invention is not limited to the specific methods and devices disclosed in such drawings or figures.

DETAILED DESCRIPTION OF A PREFERRED EMBODIMENT

The application on which this application claims priority, U.S. Provisional Patent Application No. 62/094,507, filed Dec. 19, 2014, is hereby incorporated herein by reference.

Figure 1:
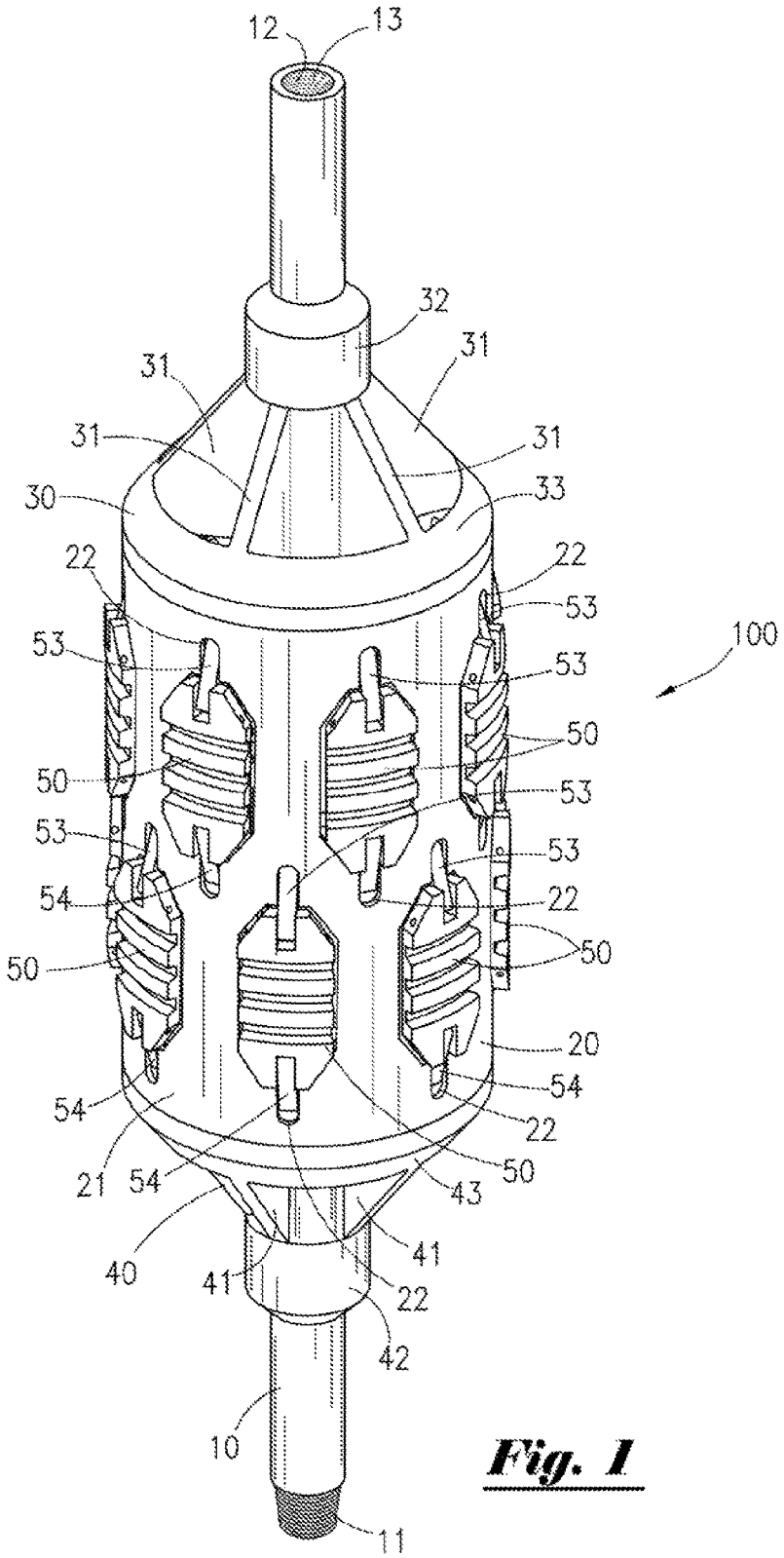
FIG. 1 depicts a side perspective view of a scraper assembly of the present invention showing a plurality of bar mechanisms in a fully extended position.

FIG. 1 depicts a side perspective view of an adjustable scraper assembly 100 of the present invention. Adjustable scraper assembly 100 of the present invention can be conveyed into a wellbore from surface, and manipulated within said wellbore, via a tubular workstring (such as drill pipe, for example). Said scraper assembly can be included within a tool string assembly (that is, as part of a combination of tools for wellbore cleanout and validation) or, alternatively, as a standalone tool that is conveyed in and out of a wellbore with few or no other associated downhole tools.

In a preferred embodiment, adjustable scraper assembly 100 comprises a substantially cylindrical or tubular inner mandrel 10. Inner mandrel 10 can include pin-end (male) threaded connection member 11 and box-end (female) threaded connection member 12. Said threaded connection members 11 and 12 can be used to connect adjustable scraper assembly 100 to other components of a tool string, or as part of a conventional jointed tubular workstring (not shown).

A central through bore 13 extends substantially along the longitudinal axis of said inner mandrel 10, and provides a fluid flow path through adjustable scraper assembly 100. As depicted in FIG. 1, pin-end (male) threaded connection member 11 is oriented facing downward, while box-end (female) threaded connection member 12 is oriented facing upward in accordance with standard oilfield convention; however, it is to be observed that said connection members 11 and 12 can be switched or interchanged to satisfy particular applications or equipment configurations.

A housing member 20 having a central through bore is rotatably disposed on said inner mandrel 10. Although other shapes can be employed without departing from the scope of the invention, in a preferred embodiment housing member 20 has a substantially cylindrical shape defining an outer surface 21. Further, housing member 20 has a greater outer diameter than the outer diameter of central mandrel 10. A plurality of elongate slots 22 is disposed along the outer surface 21 of said housing member 20; said slots 22 are oriented substantially parallel to the longitudinal axis of inner mandrel 10.

In a preferred embodiment, slotted housing member 20 is affixed to a two-part mandrel and held in place by upper retention sub 30 and lower retention sub 40. In the embodiment depicted in FIG. 1, upper retention sub 30 generally comprises base member 33, retention collar 32 and a plurality of tapered and substantially planar support members 31 extending from said retention collar 32 to said base member 33. Similarly, lower retention sub 40 generally comprises base member 43, retention collar 42 and a plurality of tapered and substantially planar support members 41 extending from said retention collar 42 to said base member 43. Slotted housing member 20, top sub 30 and bottom sub 40 are all free to rotate around inner mandrel 10.

Upper retention sub 30 and lower retention sub 40 cooperate to retain slotted housing member 20 on inner mandrel 10 and prevent said slotted housing member 20 from traveling along the length of said inner mandrel 10. Further, the tapered configuration of lower retention sub 40 (and, more particularly, the radially outward-facing surfaces of support members 41) act as a guide to direct scraper assembly 100 into a wellbore and over ledges or restrictions when being conveyed into a wellbore. Similarly, the tapered configuration of upper retention sub 30 (and, more particularly, the radially outward-facing surfaces of support members 31) act as a guide to direct scraper assembly 100 out of a wellbore and past ledges or restrictions when being pulled out of a wellbore. The design of said upper retention sub 30 and lower retention sub 40 reduce the overall weight of scraper assembly 100.

Inner mandrel 10 can include pin-end (male) threaded connection member 11 and box-end (female) threaded connection member 12. Said threaded connection members 11 and 12 can be used to connect adjustable scraper assembly 100 to other components of a tool string, or as part of a conventional jointed tubular workstring (not shown).

A central through bore 13 extends substantially along the longitudinal axis of said inner mandrel 10, and provides a fluid flow path through adjustable scraper assembly 100. As depicted in FIG. 1, pin-end (male) threaded connection member 11 is oriented facing downward, while box-end (female) threaded connection member 12 is oriented facing upward in accordance with standard oilfield convention; however, it is to be observed that said connection members 11 and 12 can be switched or interchanged to satisfy particular applications or equipment configurations.

A housing member 20 having a central through bore is rotatably disposed on said inner mandrel 10. Although other shapes can be employed without departing from the scope of the invention, in a preferred embodiment housing member 20 has a substantially cylindrical shape defining an outer surface 21. Further, housing member 20 has a greater outer diameter than the outer diameter of central mandrel 10. A plurality of elongate slots 22 is disposed along the outer surface 21 of said housing member 20; said slots 22 are oriented substantially parallel to the longitudinal axis of inner mandrel 10.

In a preferred embodiment, slotted housing member 20 is affixed to a two-part mandrel and held in place by upper retention sub 30 and lower retention sub 40. In the embodiment depicted in FIG. 1, upper retention sub 30 generally comprises base member 33, retention collar 32 and a plurality of tapered and substantially planar support members 31 extending from said retention collar 32 to said base member 33. Similarly, lower retention sub 40 generally comprises base member 43, retention collar 42 and a plurality of tapered and substantially planar support members 41 extending from said retention collar 42 to said base member 43. Slotted housing member 20, top sub 30 and bottom sub 40 are all free to rotate around inner mandrel 10.

Upper retention sub 30 and lower retention sub 40 cooperate to retain slotted housing member 20 on inner mandrel 10 and prevent said slotted housing member 20 from traveling along the length of said inner mandrel 10. Further, the tapered configuration of lower retention sub 40 (and, more particularly, the radially outward-facing surfaces of support members 41) act as a guide to direct scraper assembly 100 into a wellbore and over ledges or restrictions when being conveyed into a wellbore. Similarly, the tapered configuration of upper retention sub 30 (and, more particularly, the radially outward-facing surfaces of support members 31) act as a guide to direct scraper assembly 100 out of a wellbore and past ledges or restrictions when being pulled out of a wellbore. The design of said upper retention sub 30 and lower retention sub 40 reduce the overall weight of scraper assembly 100.

A multi-bar (typically, a so-called "four-bar") mechanism is disposed within each slot 22 of slotted housing member 20. A scraper member 50 is operationally attached to a coupler linkage of each such multi-bar linkage mechanism; said coupler linkage typically comprises an upper linkage bar member 53 and lower linkage bar member 54 that are operationally connected using a bias spring (not shown in FIG. 1) that acts to bias scraper member 50 in a substantially radially outward direction.

As depicted in FIG. 1, scraper members 50 comprise pad members having corrugated outer surfaces having alternating ridges and recesses. However, said preferred embodiment scraper members 50 are illustrative only; it is to be observed that blades or other abrading members can be used in place of (or in tandem with) scraper members 50. Scraper members 50 can be beneficially embody a curved or convex shape with a radius of curvature optimized to contact the maximum surface area of the surrounding inner surface of wellbore, oil and gas tubular good, or drilling/production marine riser intended to be cleaned.

Figure 2:
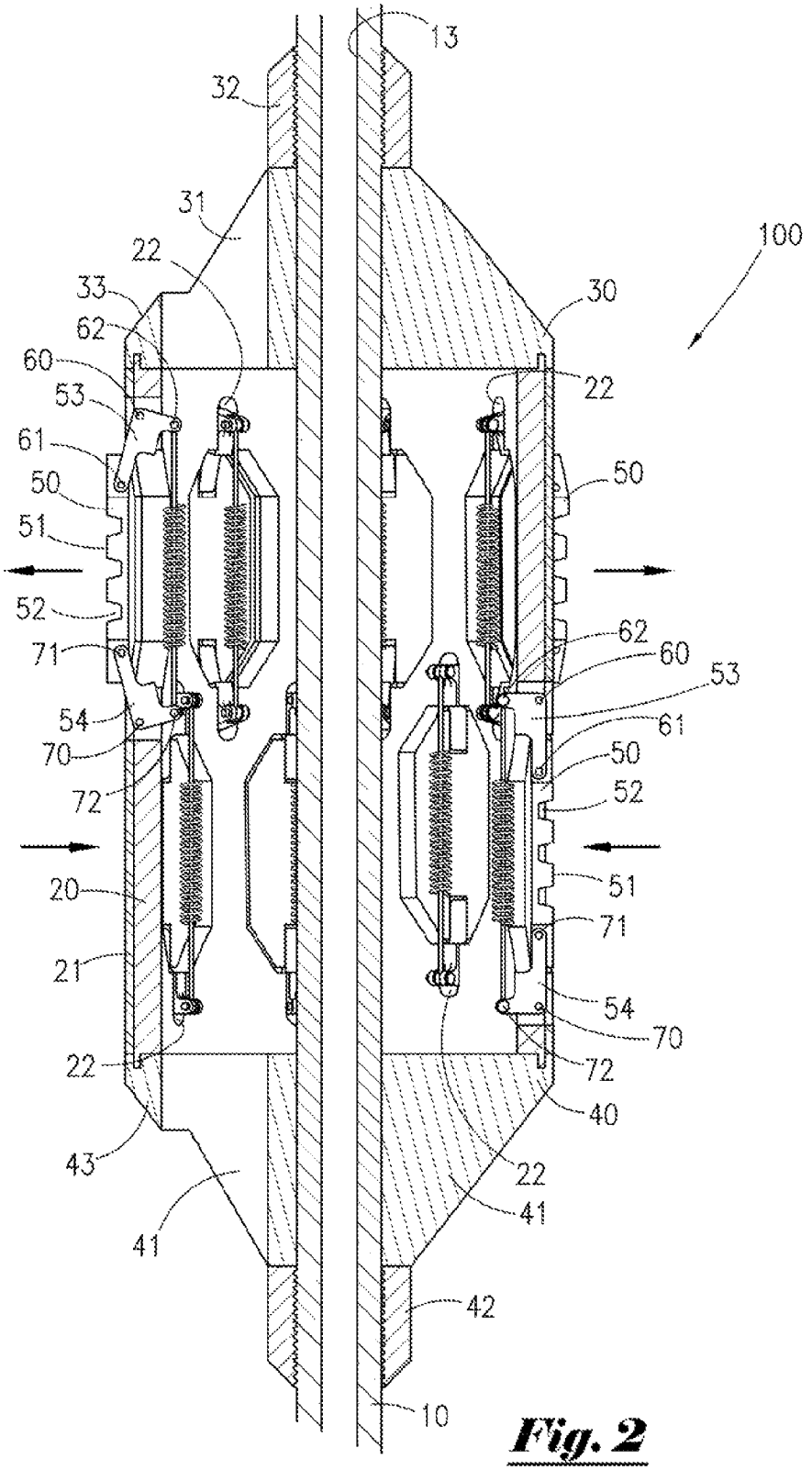
FIG. 2 depicts a side sectional view of a scraper assembly of the present invention showing a plurality of bar mechanisms in a fully collapsed position and certain bar mechanisms fully extended position.

FIG. 2 depicts a side sectional view of a scraper assembly 100 of the present invention. A central through bore 13 extends substantially along the longitudinal axis of said inner mandrel 10, and provides a fluid flow path through adjustable scraper assembly 100. Housing member 20 is rotatably disposed about the outer surface of said inner mandrel 10. A plurality of elongate slots 22 is disposed along the outer surface 21 of said housing member 20; said slots 22 extend substantially through housing member 20 and are oriented substantially parallel to the longitudinal axis of inner mandrel 10.

In a preferred embodiment, slotted housing member 20 is held in place by upper retention sub 30 and lower retention sub 40. Upper retention sub 30 generally comprises base member 33, retention collar 32 and a plurality of tapered and substantially planar support members 31 extending from said retention collar 32 to said base member 33. Lower retention sub 40 generally comprises base member 43, retention collar 42 and a plurality of tapered and substantially planar support members 41 extending from said retention collar 42 to said base member 43. Upper retention sub 30 and lower retention sub 40 cooperate to retain slotted housing member 20 on inner mandrel 10 and prevent said slotted housing member 20 from traveling along the length of said inner mandrel 10.

Still referring to FIG. 2, each multi-bar linkage mechanism comprises an upper linkage bar member 53 and lower linkage bar member 54, attached to scraper member 50, that are operationally connected by bias spring 55. In a preferred embodiment, each upper linkage bar member 53 is pivotally attached to sleeve housing 20 using pivot bolt 60; each upper linkage bar member 53 can rotate about a pivot axis passing through said pivot bolt 60. Each upper linkage bar member 53 is also pivotally attached to scraper member 50 using pivot bolt 61, as well as to bias spring 55 using pivot bolt 62. Each lower linkage bar member 54 is pivotally attached to sleeve housing 20 using pivot bolt 70; lower linkage bar member 54 can rotate about a pivot axis passing through said pivot bolt 70. Each lower linkage bar member 54 is also pivotally attached to scraper member 50 using pivot bolt 71 and to bias spring 55 using pivot bolt 72.

Springs 55 exert compression forces that bias upper linkage bar members 53 and lower linkage bar members 54 together, thereby forcing scraper member 50 in a substantially radially outward direction. In the embodiment depicted in FIG. 2, the "upper" set of bar mechanisms (that is, the bar mechanisms closest to top retention sub 30) are shown in a fully extended position, while the "lower" set of bar mechanisms (that is, the bar mechanisms closest to bottom retention sub 40) are shown in a fully collapsed or retracted position.

Figure 3A:
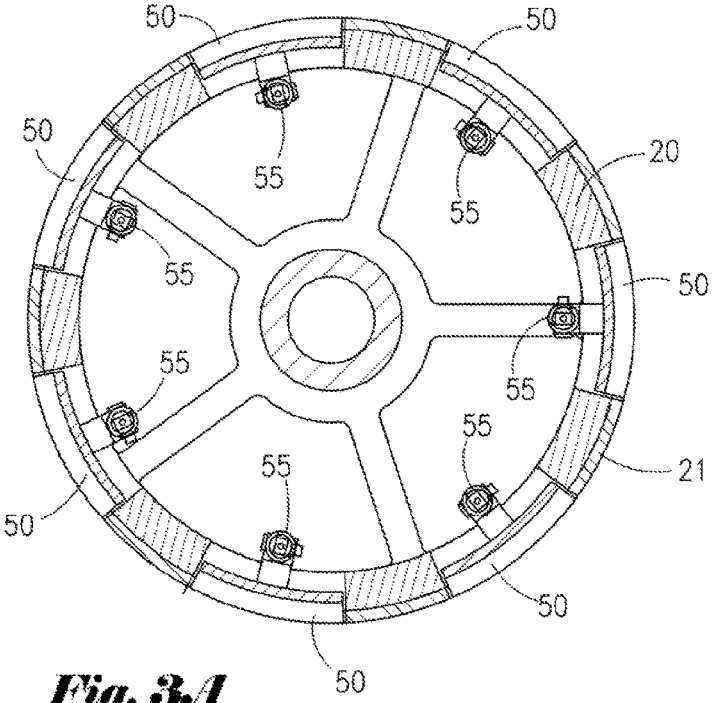
FIG. 3A depicts an overhead sectional view of a scraper assembly of the present invention showing a plurality of bar mechanisms in a fully collapsed position.

FIG. 3A depicts an overhead sectional view of scraper assembly 100 of the present invention with a plurality of bar mechanisms and attached scraper members 50 in a fully collapsed position (i.e., substantially the same configuration as the "lower" set of bar mechanisms depicted in FIG. 2). In the view depicted in FIG. 3A, bias springs 55 are partially extended, and scraper members 50 do not extend radially outward beyond the outer surface 21 of sleeve housing 20.

Figure 3B:
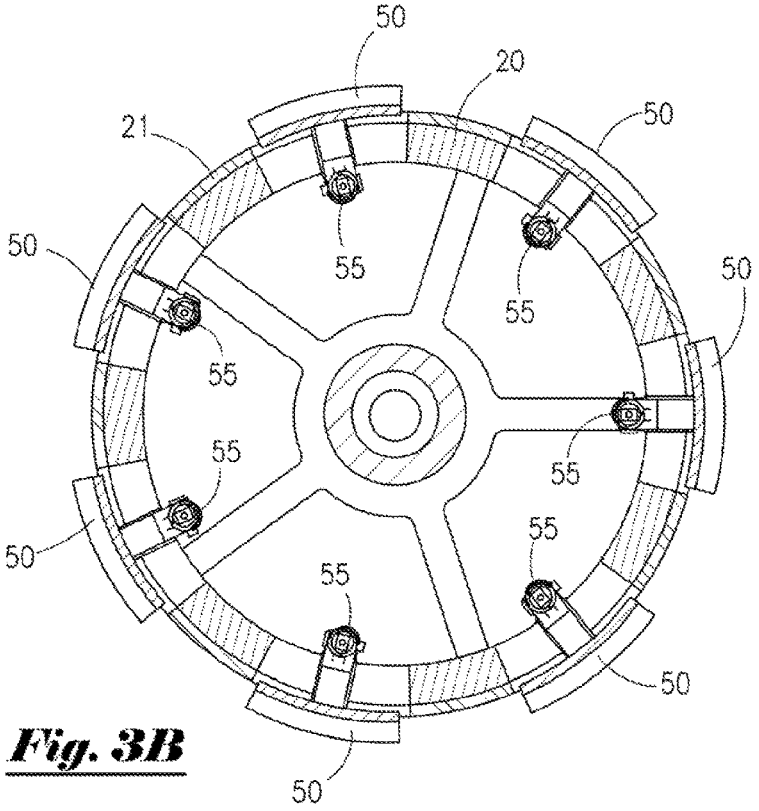
FIG. 3B depicts an overhead sectional view of a scraper assembly of the present invention showing a plurality of bar mechanisms in a fully extended position.

FIG. 3B depicts an overhead sectional view of a scraper assembly 100 with a plurality of bar mechanisms and attached scraper members 50 in a fully extended position (i.e., substantially the same configuration as the "upper" set of bar mechanisms depicted in FIG. 2). In the view depicted in FIG. 3B, bias springs 55 are retracted, and scraper members 50 protrude radially outward beyond the outer surface 21 of sleeve housing 20.

Figure 4:
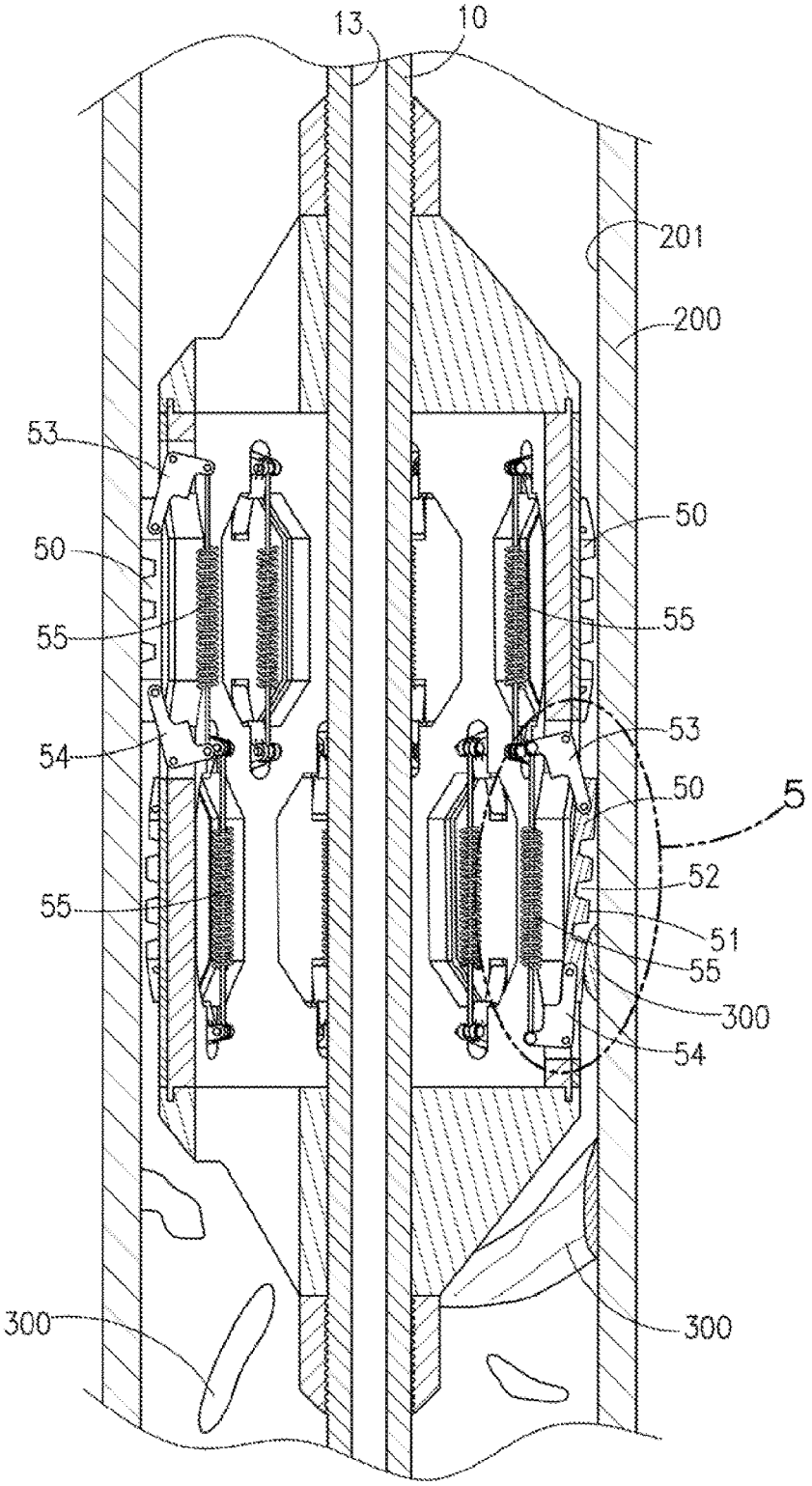
FIG. 4 depicts a side sectional view of a scraper assembly of the present invention disposed within a section of well casing.
Figure 5:
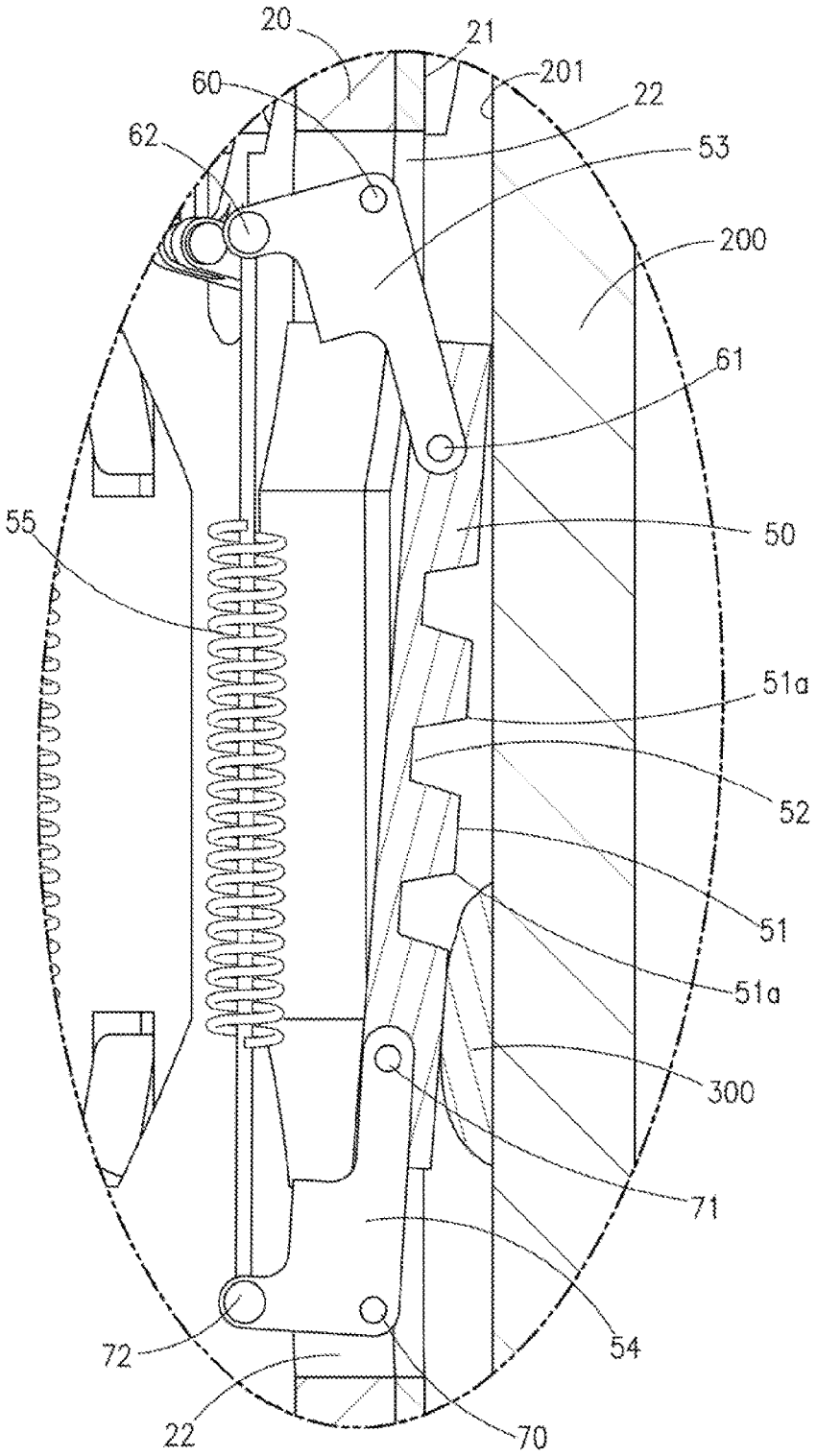
FIG. 5 depicts a detailed view of the highlighted area depicted in FIG. 4.

FIG. 4 depicts a side sectional view of an adjustable scraper assembly 100 of the present invention disposed within a section of well casing 200, while FIG. 5 depicts a detailed view of the highlighted area depicted in FIG. 4. In operation, adjustable scraper assembly 100 of the present invention can be conveyed into a wellbore from surface, via a tubular workstring (such as drill pipe, for example), and manipulated within well casing 200. Although other configurations can be used without departing from the scope of the present invention, mandrel 10 can be connected or made up to a tubular workstring, while central through bore 13 provides a flow channel for flow of fluids through said scraper assembly 100.

As depicted in FIGS. 4 and 5, well casing 200 has inner surface 201. In many circumstances including, without limitation, following well cementing operations, debris 300 can collect along said inner surface 201. Frequently, such debris 300 can comprise cement chunks, partially dried drilling mud particulates or other deposited solids. As discussed above, it is operationally beneficial to remove as much of debris 300 as possible from said inner surface 201.

Referring to FIG. 5, upper linkage bar member 53 is pivotally attached to sleeve housing 20 using pivot bolt 60 and can rotate about a pivot axis passing through said pivot bolt 60. Upper linkage bar member 53 is also pivotally attached to scraper member 50 using pivot bolt 61, and to bias spring 55 using pivot bolt 62. Similarly, lower linkage bar member 54 is pivotally attached to sleeve housing 20 using pivot bolt 70 and can rotate about a pivot axis passing through said pivot bolt 70. Lower linkage bar member 54 is also pivotally attached to scraper member 50 using pivot bolt 71 and to bias spring 55 using pivot bolt 72.

As said adjustable scraper assembly 100 is conveyed within well casing 200, bias springs 55 impart compression force on upper linkage bars 53 and lower linkage bars 54. Such compression forces act to bias scraper members 50 radially outward from slotted sleeve housing 20; in this configuration, the outwardly-facing surfaces of scraper members 50 contact inner surface 201 of well casing 200.

In a preferred embodiment, lower linkage bars 54 (positioned closer to the "down hole" end of scraper assembly 100) are longer than upper linkage bars 53 (positioned closer to the "up hole" facing end of scraper assembly 100). Such a configuration ensures that the multi-bar linkage systems (including, without limitation, scraper members 50) depress first from the down hole (leading) end of the coupler linkage when immovable obstructions or wellbore restrictions such as debris 300 are encountered.

When debris 300 (which is deposited on the inner surface 201 of well casing 200) is encountered, ridges 51 of scraper member 50 act to abrade or scrape said debris 300 from said inner surface 201. Shoulders 51*a* formed by the transition between ridges 51 and recesses 52 provide a sharp cutting surface to assist with said scraping action. When a restriction of the inner diameter of well casing 200 is encountered, bias spring 55 permits scraper member 50 to fully or partially collapse radially inward.

Said multi-bar mechanisms provide an adjustable, wide range of outer diameter coverage in substantially a 360-degree pattern around the outer surface 21 of slotted housing 20 and, thus, the outer circumference of said scraper assembly 100. To achieve 360-degree abrasive coverage of a wellbore, oil and gas tubular, or drilling/production marine riser annulus, multiple multi-bar linkage systems (generally comprising upper linkage bars 53, lower linkage bars 54, bias springs 55 and scraper members 50) are disposed within slots 22 of sleeve housing 20. Each slot 22 is positioned in phased relationship in order to overlap or ensure complete circumferential coverage when a scraper coupler linkage is fully extended. Moreover, multiple "stacked" scraper assemblies 100 can be run in tandem in order to further ensure 360-degree abrasive coverage of surrounding wellbore surfaces.

Said multi-bar mechanisms also apply significant force in an outward radial direction, thereby forcing scraper members 50 outward relative to housing 20. Such force is generally applied in a direction that is substantially perpendicular to the longitudinal axis of said scraper assembly 100 for effective abrasion of corrosive buildup, deposits and/or scale on surrounding surfaces. Central flow bore 13 extending through inner mandrel 10 permits fluid to be circulated through said scraper assembly 100 to circulate solids and debris out of a wellbore being mechanically cleaned with said scraper assembly 100.

The above-described invention has a number of particular features that should preferably be employed in combination, although each is useful separately without departure from the scope of the invention. While the preferred embodiment of the present invention is shown and described herein, it will be understood that the invention may be embodied otherwise than herein specifically illustrated or described, and that certain changes in form and arrangement of parts and the specific manner of practicing the invention may be made within the underlying idea or principles of the invention.

The invention claimed is:

1. A mechanical wellbore abrading assembly comprising:

a) a housing member having a central through bore, an outer surface and at least one aperture in said outer surface;

b) a central mandrel disposed through said central bore of said housing member;

c) at least one scraper assembly comprising:

i) a first linkage member pivotally attached to said housing member;

ii) a second linkage member pivotally attached to said housing member;

iii) an abrasive member disposed within said at least one aperture, wherein said abrasive member is pivotally attached to said first linkage member and said second linkage member, and is biased in a direction radially outward from said outer surface of said housing member; and iv) a bias spring having a first end and a second end, wherein said first end is operationally attached to said first linkage member and said second end is operationally attached to said second linkage member.

2. The mechanical abrading assembly of claim 1, wherein said bias spring imparts a compressive force.

3. The mechanical abrading assembly of claim 2, wherein said bias spring is oriented substantially parallel to the longitudinal axis of said central mandrel.

4. A method for cleaning the inner surface of a marine riser or wellbore comprising:

a) installing a mechanical scraper assembly on a tubular work string, wherein said mechanical scraper assembly comprises:

i) a housing member having a central through bore, an outer surface and a plurality of apertures in said outer surface;

ii) a central mandrel disposed through said central bore of said housing member;

iii) a plurality of abrading assemblies, wherein each abrading assembly comprises:

aa) a first linkage member pivotally attached to said housing member;

bb) a second linkage member pivotally attached to said housing member; and cc) an abrasive member disposed within an aperture, wherein said abrasive member is pivotally attached to said first linkage member and said second linkage member, and is biased in a direction radially outward from said outer surface of said housing member;

dd) a bias spring having a first end and a second end, wherein said first end is operationally attached to said first linkage member and said second end is operationally attached to said second linkage member;

b) conveying said mechanical scraper assembly in said marine riser or wellbore on said tubular workstring; and c) scraping said inner surface of a marine riser or wellbore with said scraper assembly.

5. The method of claim 4, wherein said bias spring comprises a compression spring that pulls said first and second linkage members toward each other.

6. The method of claim 5, wherein said abrasive member is at least partially depressed radially inward when said abrasive member contacts an obstruction on said inner surface of said marine riser or wellbore.

* * * * *